US008960102B2

(12) United States Patent
Rheault et al.

(10) Patent No.: US 8,960,102 B2
(45) **Date of Patent: *Feb. 24, 2015**

(54) DUAL HEIGHT WORKSTATION CONFIGURATION

(71) Applicant: Steelcase Inc., Grand Rapids, MI (US)

(72) Inventors: Alan E Rheault, Grand Rapids, MI (US); Karl J Mead, East Grand Rapids, MI (US); George K Vangelatos, Fair Oaks, CA (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/934,495

(22) Filed: Jul. 3, 2013

(65) Prior Publication Data

US 2013/0291765 A1 Nov. 7, 2013

Related U.S. Application Data

(63) Continuation of application No. 13/470,465, filed on May 14, 2012, now Pat. No. 8,499,699, which is a continuation of application No. 12/466,746, filed on May 15, 2009, now Pat. No. 8,196,526.

(51) Int. Cl.

| | |
|---|---|
| ***A47B 37/00*** | (2006.01) |
| ***A47B 21/00*** | (2006.01) |
| ***A47B 13/10*** | (2006.01) |

(52) U.S. Cl.

CPC ..... *A47B 21/00* (2013.01); *A47B 13/10* (2013.01)

USPC ..... 108/50.01; 108/50.02; 312/223.6

(58) Field of Classification Search

USPC ..... 108/50.01, 50.02, 147, 108, 152; 312/196, 223.6, 257.1, 194, 195, 265.1

See application file for complete search history.

(56) References Cited

U.S. PATENT DOCUMENTS

| | | | |
|---|---|---|---|
| 3,920,299 | A | 11/1975 | Propst et al. |
| 4,116,509 | A | 9/1978 | Smith |
| D278,583 | S | 4/1985 | Koguma |
| D279,740 | S | 7/1985 | Slager |
| 4,604,955 | A | 8/1986 | Fleischer et al. |
| 4,679,510 | A | 7/1987 | Veyhl et al. |
| D303,188 | S | 9/1989 | Risom |
| D305,585 | S | 1/1990 | Wright |
| D306,101 | S | 2/1990 | Borsani |
| D317,090 | S | 5/1991 | Koguma |
| 5,094,174 | A | 3/1992 | Grund et al. |
| 5,183,319 | A | 2/1993 | Pearson et al. |
| 5,224,429 | A | 7/1993 | Borgman et al. |

(Continued)

*Primary Examiner* — Jose V Chen

(74) *Attorney, Agent, or Firm* — Quarles & Brady LLP

(57) ABSTRACT

A work surface arrangement comprising a support structure extending upward from a base end, a first work surface forming member supported by the support structure at a first vertical height, a second work surface forming member supported by the support structure at a second vertical height and extending to a first side of the support structure where the second vertical height is lower than the first vertical height, the second member including an undersurface, a first cover supported by the support structure and extending downward below the first member to a lower edge below the second vertical height, a second cover supported by the support structure and extending downward from a height proximate the undersurface of the second member and spaced from the first cover to bound a cavity, at least one horizontal channel supported by the support structure between the first and second work surface forming members to face the first side.

27 Claims, 15 Drawing Sheets

(56) References Cited

U.S. PATENT DOCUMENTS

| | | | |
|---|---|---|---|
| 5,323,695 | A | 6/1994 | Borgman et al. |
| 5,339,750 | A | 8/1994 | Smies |
| 5,394,809 | A | 3/1995 | Feldpausch et al. |
| 5,403,232 | A | 4/1995 | Helm et al. |
| 5,443,017 | A | 8/1995 | Wacker et al. |
| D368,388 | S | 4/1996 | Schainholz |
| 5,522,324 | A | 6/1996 | van Gelder et al. |
| D371,699 | S | 7/1996 | Muller-Deisig et al. |
| 5,531,168 | A | 7/1996 | Towfigh |
| D372,817 | S | 8/1996 | Stevens |
| D377,873 | S | 2/1997 | Flototto |
| 5,609,112 | A | 3/1997 | Meyer et al. |
| 5,752,449 | A | 5/1998 | Simon et al. |
| 5,845,587 | A | 12/1998 | Ditonto |
| 5,901,513 | A | 5/1999 | Mollenkopf et al. |
| D414,350 | S | 9/1999 | Fear et al. |
| 5,979,118 | A | 11/1999 | Gortsema et al. |
| D422,429 | S | 4/2000 | Belka et al. |
| 6,076,474 | A | 6/2000 | Grabowski et al. |
| 6,101,954 | A | 8/2000 | Rein et al. |
| 6,196,140 | B1 | 3/2001 | Newhouse et al. |
| 6,267,064 | B1 | 7/2001 | Ostertag et al. |
| D446,028 | S | 8/2001 | Ruedinger et al. |
| 6,283,043 | B1 | 9/2001 | Stern et al. |
| 6,286,441 | B1 | 9/2001 | Burdi et al. |
| 6,374,548 | B1 | 4/2002 | Ruedinger et al. |
| 6,484,647 | B2 | 11/2002 | Lininger, Jr. et al. |
| 6,609,465 | B2 | 8/2003 | Kolavo |
| 6,615,747 | B2 | 9/2003 | Stenftenagel et al. |
| 6,725,784 | B2 | 4/2004 | Crinion |
| 6,732,660 | B2 | 5/2004 | Dame et al. |
| D496,536 | S | 9/2004 | Chang |
| 6,964,234 | B2 | 11/2005 | Chang |
| 6,990,909 | B2 | 1/2006 | Gosling et al. |
| 7,036,438 | B2 | 5/2006 | Okamoto et al. |
| D547,097 | S | 7/2007 | Bastian et al. |
| D547,971 | S | 8/2007 | Lachance et al. |
| 7,278,360 | B2 | 10/2007 | Griepentrog |
| 7,343,864 | B2 | 3/2008 | Canin et al. |
| 7,357,086 | B2 | 4/2008 | Petrick et al. |
| D569,142 | S | 5/2008 | Burak |
| 7,712,847 | B1 | 5/2010 | Albright et al. |
| 7,748,328 | B2 | 7/2010 | Horton |
| 7,934,459 | B2 | 5/2011 | Frazier |
| 8,109,215 | B2 | 2/2012 | Kitada et al. |
| 8,196,526 | B2 | 6/2012 | Rheault et al. |
| 8,499,699 | B2 * | 8/2013 | Rheault et al. ..... 108/50.01 |
| 2002/0073900 | A1 | 6/2002 | Birsel et al. |
| 2004/0211343 | A1 | 10/2004 | Song |
| 2005/0263041 | A1 | 12/2005 | Mueller et al. |
| 2005/0284341 | A1 | 12/2005 | Klassy et al. |

* cited by examiner

DUAL HEIGHT WORKSTATION CONFIGURATION

CROSS-REFERENCE TO RELATED APPLICATIONS

This application is a continuation of U.S. patent application Ser. No. 13/470,465 which was filed on May 14, 2012 which was a continuation of U.S. patent application Ser. No. 12/466,746 which was filed on May 15, 2009, both of which have the same title as this application.

STATEMENT REGARDING FEDERALLY SPONSORED RESEARCH OR DEVELOPMENT

Not applicable.

BACKGROUND OF THE INVENTION

The present invention relates to workstations generally and more specifically to a two sided workstation that includes different level work surfaces to accommodate both sitting and standing workstation users.

A workstation usually includes a support structure, at least one horizontal work surface supported by the support structure and one or more computers including processors, display screens and data entry devices such as keyboards, a mouse, etc. Some workstations are used in many different ways by several different users at different times and, in some cases, simultaneously. For instance, in the case of a nurse station located in a medical facility, workstations have been routinely used for many different purposes. For example, some medical facilities operate twenty-four hours a day and seven days a week and are used by three or more shifts of nurses and doctors during the course of a typical day. In these cases, a station may simultaneously generally serve the needs of several nurses and doctors in a facility as well as serve as a reception station for patients and/or visitors arriving at an area of the facility.

In the past, nurses and administrators using a station have often been assigned different general tasks. For instance, some administrative nurses have been primarily responsible for entering data into databases using a computer, maintaining a schedule of resource use within an associated area of a facility, greeting patients within an area of a facility etc., while other patient attending nurses have been primarily responsible for tending to patients within an associated area of the facility.

In the past, patient attending nurses have typically used paper reporting tools for tracking/recording patient care activities while administrative nurses have routinely used computers to perform their tasks (e.g., data entry including entering data recorded by the patient attending nurses, scheduling, etc.). In these cases, patient attending nurses typically have only stopped at a nurse station for short periods to obtain information required to complete their duties associated with tending to patients and providing information to the administrative nurses while administrative nurses have generally spent a relatively greater portion of their time at the nurse station to complete their assigned tasks.

To support both administrative and patient attending nurses as well as serve as a reception area for patients/visitors, nurse stations have usually included a relatively large work surface at a height suitable for use by a sitting nurse and a relatively small horizontal surface at a height suitable for use by a standing nurse or a patient/visitor. Here, the station typically included one or more computers with displays located for use by administrative nurses and the smaller, standing height surface was generally for use by the patient attending nurses. Because the patient attending nurses and patients/visitors performed only few tasks at the station, the smaller standing height surface was always considered adequate to meet their periodic and minimal needs. Because some nurses where tasked with stationary tasks and others with ambulatory tasks, the stations often included complete surrounding structure to, in effect, close off the space used by the administrative nurses and operate as a barrier to easy access. The surrounding configuration was also seen as advantageous as it restricted access by patients or other facility visitors to locations where sensitive patient information was accessible/viewable (e.g., via a display).

In these cases, the side of the station on which patients/visitors approached was usually finished in a particularly aesthetically appealing manner while the side on which the administrators were seated had a design dictated more by function than form. Computer housings, network routers and other electronic equipment was usually stored under the large sitting height work surface in a location accessible from adjacent the large work surface but hidden from view on the other side of the station (i.e., hidden from the side from which a patient would typically approach the station).

Today, while there are still nurses that are assigned to different tasks within medical facilities, the lines between the duties performed by nurses of different types are not as bright as they once were. For instance, in the case of a patient attending nurse, often the nurse will record care information using an electronic palm type computing device and will transfer the recorded information corresponding to several patients (e.g., the patients associated with one round made by the nurse) to a persistent patient database linked to a facility computer network for permanent storage. In these cases, data transfer is usually performed at a nurse station where the nurse has the ability to review and modify the recorded data via a relatively large display screen (e.g., a desk top computer display as opposed to a smaller palm type display) prior to final storage in the persistent database.

As another instance, patient attending nurses in many facilities now also use computers based at nurse stations for other purposes such as obtaining detailed information about patients, additional information about drugs and/or treatments, checking or modifying schedules, entering narrative information concerning patients, etc.

While the tasks performed by different types of nurses have changed, unfortunately, nurse station configurations for supporting the different tasks have not changed very much. To this end, when a patient attending nurse has to access a computer to access information or enter information, in order to access the computer, the nurse has to physically enter the workstation structure that separates the station space from the surrounding common or "public" area. While movement into the surrounding station structure may not seem too burdensome at first blush, in reality, a patient attending nurse may have to access a computer at the station twenty or more times during an eight hour shift and in some cases for only a very short period (e.g., 20 seconds), and movement into and out of the station space can be a nuisance.

One solution is to open up the station space so that the large sitting height work surface can be approached from lateral sides in addition to along a front edge. In this case, a patient attending nurse can move into a position adjacent the sitting height work surface to access a computer without having to move through a circuitous path through an entry space into the station surrounding structure.

While existing "open" nurse stations are advantageous in some applications, such stations still have several shortcomings. First, while the sitting height work surface is approachable from multiple sides by a nurse, the surface is also approachable from the same sides by any patient or facility visitor in the general area and all of the clutter associated with computer equipment located under the work surface is observable.

Second, while an open nurse station allows a generally ambulatory nurse to move into a seated position adjacent a display and computer input devices, even the action of assuming a seated position is a nuisance in cases where a nurse has to access a computer for multiple short durations (e.g., 20 seconds) during a typical shift. Here, the simple task of assuming a seated position as opposed to maintaining a standing position during short computer access periods is time consuming and burdensome.

Third, where an ambulatory nurse requires a work surface for a short period, the small standing height surfaces provided by known nurse stations are typically too small for a nurse's needs. This is particularly true in cases where a nurse still records services via paper mounted to clip boards where, in many cases, the clipboards themselves are larger than a depth dimension of the standing height surface or where a nurse uses a laptop computer and attempts to support the laptop on top of the work surface.

BRIEF SUMMARY OF THE INVENTION

It has been recognized that a dual height workstation can be configured that includes standing and sitting height work surfaces where each of the surfaces has a depth dimension that is suitable for supporting data entry type computing devices including displays, keyboards, a mouse, etc., and where a housing resides below the work surfaces that forms a cavity in which computers, routers and other electronic components can be stored in a hidden fashion. This configuration is particularly advantageous as all computing devices except for data entry and output devices can be hidden from view and therefore a station can be constructed wherein the station has an uncluttered and aesthetically pleasing appearance regardless of the vantage points of persons viewing the station. In at least some cases the station is generally open in that there is no structure that restricts access to the sitting height surface from the sides.

It has also been recognized that, in at least some applications, it is advantageous to provide display screens for data entry and access while using the standing height work surface so that persons can use computer interface devices in either standing or sitting positions, depending on the user's current needs. In at least some applications the display screens are flat panel monitors so that output can be provided without requiring a large amount of space on the work surface. In some embodiments the work surfaces are supported by two vertical, rigid and elongated support legs where the standing height surface is substantially the same height as top ends of the legs and where the monitor support arms are mounted to the top ends of, and are supported by, the legs. This embodiment is particularly advantageous as the leg structure serves a dual purpose of supporting the work surfaces and the display arm so that additional mounting structure for a support arm is not required or is substantially minimized. In at least some cases two monitor arms are mounted to the top end of at least one of the legs where one monitor is arranged to be used on one side of the station and the other monitor is to be used on the other side of the station.

Where the station is also used as a reception structure, displays provided above the standing height work surface can be moved via articulating arms to locations generally out of the way so that a patient/visitor being "received" can communicate with a nurse located at the sitting height work surface. In other cases, one or more of the displays may be moved to locations suitable for presenting information to arriving patients/visitors and may be used to presenting greeting or check in information.

In at least some embodiments the work surface forming members have curved shapes that, in effect, define different work surface areas that are intended for different types of activities. For instance, in at least some embodiments, each of the work surface forming members includes a curved front edge where the curved edge has first and second ends, is convex near both ends and is concave near a center portion between the two convex end portions. In this case, each convex portion provides an area that is relatively deep and that is suitable for supporting data entry and display components and each concave portion is relatively shallow. Thus, where a member includes two convex portions, the member can form two separate workstation spaces that are spatially separated by a concave portion therebetween.

Where the work surface forming members have the concave portions generally aligned, the concave portions together form a space which is suitable for reception purposes. In this regard, when a nurse is receiving a patient/visitor, communication is enhanced when the space between a nurse and the patient/visitor is reduced. During reception activities, a nurse can assume a position within the concave portion of the sitting height work surface and the patient/visitor can likewise assume a position within the concave portion of the standing height work surface and the overall distance between the nurse and patient/visitor can be reduced appreciably. Thus, the convex portions can provide suitable and relatively deep workstation spaces while the concave portions provide suitable and relatively narrow reception areas.

In at least some embodiments the station housing below the work surface forming tops includes first and second lateral side walls that form a housing cavity space therebetween and front and rear covers that are used to close the front and rear areas of the cavity between the side walls. In some embodiments the covers below the work surface forming members are spaced apart from the supporting legs so that a relatively wide portion of the cavity is formed therebetween. In some embodiments a top rear cover extends from the undersurface of the standing height work surface to a height substantially at the height of the top surface of the sitting height work surface. In some cases, the top rear cover is located within a space defined by the supporting legs and in fact, in some cases, portions of the supporting legs stand "proud" of the top rear cover so that the legs and external surface of the cover form a recessed cavity. In some cases a rear edge of the standing height work surface forming member extends past the external surface of the top rear cover to further define the cavity. In some cases the external surface of the top rear cover includes slat wall structure so that monitor arms and other accessories can be secured to, and supported by, that surface as well known in the office furniture art.

In at least some embodiments one or more of the covers are supported in a fashion so that the covers are easily moved from closed positions wherein the housing cavity is enclosed to an open position wherein a user can gain ready access to the cavity for installing, maintaining and/or replacing electronic components and/or power and data cables. In some embodiments one or more covers are mounted to hinges proximate bottom edges so that the covers can be easily moved into open positions.

Some embodiments includes a work surface arrangement comprising at least a first support member extending upward from a base end when the base end is received on a support surface, a first work surface forming member supported by the first support member at a first vertical height and extending to a first side from the first support member, a second work surface forming member supported by the first support member at a second vertical height and extending to a second side opposite the first side of the first support member where the second vertical height is different than the first vertical height, a housing forming a housing cavity, the housing including (i) a front cover extending below the first work surface forming member, (ii) a substantially vertical upper back cover extending downward from the first work surface forming member substantially to the second vertical height proximate the second work surface forming member and spaced from the front cover wherein the upper back cover and the front cover bound an upper housing cavity width and (iii) a lower back cover extending below the second work surface forming member and spaced from the front cover wherein the lower back cover and the front cover bound a lower housing cavity width that is larger than the upper housing cavity width.

In some cases the support member includes at least first and second substantially vertical and spaced apart leg members. In some cases the first and second leg members include first and second parallel surfaces that are within first and second leg planes and wherein the front and upper back and lower back covers are located within a space between the first and second leg planes. In some cases the first and second leg members together define a vertical arrangement plane and wherein the lower back cover and the front cover are substantially the same distance from the vertical arrangement plane. In some cases at least one of the second work surface forming member and the first work surface forming member forms first and second openings and wherein the first and second leg members pass at least in part through the first and second openings, respectively.

In some cases the at least one of the first and second work surface forming members that forms the first and second openings includes a rear edge proximate the first and second leg members and wherein the first and second openings include first and second notches in the rear edge through which portions of the first and second leg members pass. In some cases the at least one of the first and second work surfaces forming members is the first work surface forming member. In some cases the second work surface forming member forms an opening and wherein the first and second leg members pass at least in part through the opening formed by the second work surface forming member.

In some cases each of the first and second work surface forming members includes a rear edge proximate the first and second leg members and wherein the first and second openings include first and second notches in the rear edge of the first work surface forming member and the opening formed by the second work surface forming member includes a notch formed in the rear edge of the second work surface forming member through which portions of the first and second leg members pass. In some cases a portion of the first work surface forming member proximate the rear edge of the first work surface forming member vertically overlaps a portion of the second work surface forming member proximate the rear edge of the second work surface forming member. In some cases top ends of the first and second leg members are substantially flush with a top surface of the second work surface forming member.

In some cases each of the first and second work surface forming members includes a rear edge proximate the support member and wherein a portion of the first work surface forming member proximate the rear edge of the first work surface forming member vertically overlaps a portion of the second work surface forming member proximate the rear edge of the second work surface forming member. In some cases the front cover is hingedly supported by the support member to allow movement between a substantially vertical closed position wherein the front cover restricts access to the housing cavity and an open position wherein the front cover is positioned to enable access to the cavity. In some cases the upper back cover includes a slat wall portion that faces a top surface of the second work surface forming member. In some cases the arrangement further includes a monitor support assembly mounted at a top end of at least one of the first and second leg members. In some cases the arrangement further includes first and second support assemblies mounted at the top end of at least one of the first and second leg members and flat panel monitors supported by each of the first and second support assemblies. In some cases the first and second leg members each have oppositely facing front and back surfaces, the front surfaces facing in the same direction and lying within a front surface plane and the back surfaces facing in the same direction and lying within a back surface plane, the front and back surface planes defining a support structure volume therebetween. In some cases the upper back cover is positioned within the support structure volume so that a portion of the support structure volume is exposed between the upper back cover and the back surface plane.

In some embodiments the second work surface forming member includes a rear edge proximate the first and second leg members and wherein the rear edge of the second work surface forming member forms a gap with a facing surface of the upper back cover where the gap leads into the housing cavity. In some cases the front cover, upper back cover and lower back cover are substantially parallel. In some embodiments the upper housing cavity width is between two inches and ten inches and wherein the lower cavity width is between five inches and twenty-four inches. In some cases at least one of the first and second work surface forming members has a rear edge proximate the support member and a curved front edge wherein the curved front edge includes at least first and second convex portions and at least one concave portion between the first and second convex portions where a depth dimension of each of the convex portions is greater than a depth dimension of the concave portion.

In some embodiments each of the first and second work surface forming members has a rear edge proximate the support member and a curved front edge wherein the curved front edge includes at least first and second convex portions and at least one concave portion between the first and second convex portions where a depth dimension of each of the convex portions is greater than a depth dimension of the concave portion and wherein the concave portions of the first and second work surface forming members are aligned.

Other embodiments include a workstation comprising first and second vertical and spaced apart leg members wherein the first and second leg members each have oppositely facing front and back surfaces, the front surfaces facing in a first direction and lying within a front surface plane and the back surfaces facing in a second direction and lying within a back surface plane, the front and back surface planes defining a support structure volume therebetween, a first work surface forming member supported by and extending from the leg members at a first vertical height and in the first direction, a second work surface forming member supported by and extending from the leg members at a second vertical height and in the second direction, a front cover extending downward from an undersurface of the first work surface forming member, an upper back cover extending downward from the first work surface forming member substantially to the second vertical height proximate the second work surface forming member and a lower back cover extending downward from an undersurface of the second work surface forming member, wherein, the front cover and lower back cover are spaced on opposite sides of the support structure volume and the upper back cover is positioned within the support structure volume and extends between the first and second leg members.

In some embodiments the upper back cover is spaced from and substantially parallel to the back surface plane. In some cases the upper back cover extends from the undersurface of the first work surface forming member. In some embodiments the second work surface forming member includes a rear edge proximate the first and second leg members and wherein at least a portion of the rear edge of the second work surface forming member forms a gap with an adjacent surface of the upper back cover.

Other embodiments include a work surface arrangement comprising at least a first support member extending upward from a base end when the base end is received on a support surface, a first work surface forming member supported by the first support member at a first vertical height and extending to a first side from the first support member and a second work surface forming member supported by the first support member at a second vertical height and extending to a second side opposite the first side of the first support member where the second vertical height is different than the first vertical height, wherein each of the first and second work surface forming members has a rear edge proximate the support member and a curved front edge wherein the curved front edge includes at least first and second convex portions and at least one concave portion between the first and second convex portions where a depth dimension of each of the convex portions is greater than a depth dimension of the concave portion and wherein the concave portions of the first and second work surface forming members are aligned.

Still other embodiments include a work surface arrangement comprising at least a first support member extending upward from a base end when the base end is received on a support surface, the first support member having a top end, a work surface forming member supported by the first support member at a vertical height and extending to a first side from the first support member and a monitor support assembly mounted to the top end of the support member for supporting a flat panel monitor above a top surface of the work surface forming member.

In some embodiments the first support member forms an opening at the top end, the arrangement further including an insert that is received in the opening at the top end of the first support member, the insert forming at least one socket for receiving an end of the monitor support assembly. In some cases the insert forms at least two sockets, each socket for receiving and retaining a separate one of the monitor support assemblies. In some cases the top end of the first support member is substantially flush with a top surface of the work surface forming member. In some embodiments the first work surface forming member forms an opening and wherein the top end of the first support member extends through the opening formed by the work surface.

To the accomplishment of the foregoing and related ends, the invention, then, comprises the features hereinafter fully described. The following description and the annexed drawings set forth in detail certain illustrative aspects of the invention. However, these aspects are indicative of but a few of the various ways in which the principles of the invention can be employed. Other aspects, advantages and novel features of the invention will become apparent from the following detailed description of the invention when considered in conjunction with the drawings.

DETAILED DESCRIPTION OF THE INVENTION

Figure 1:
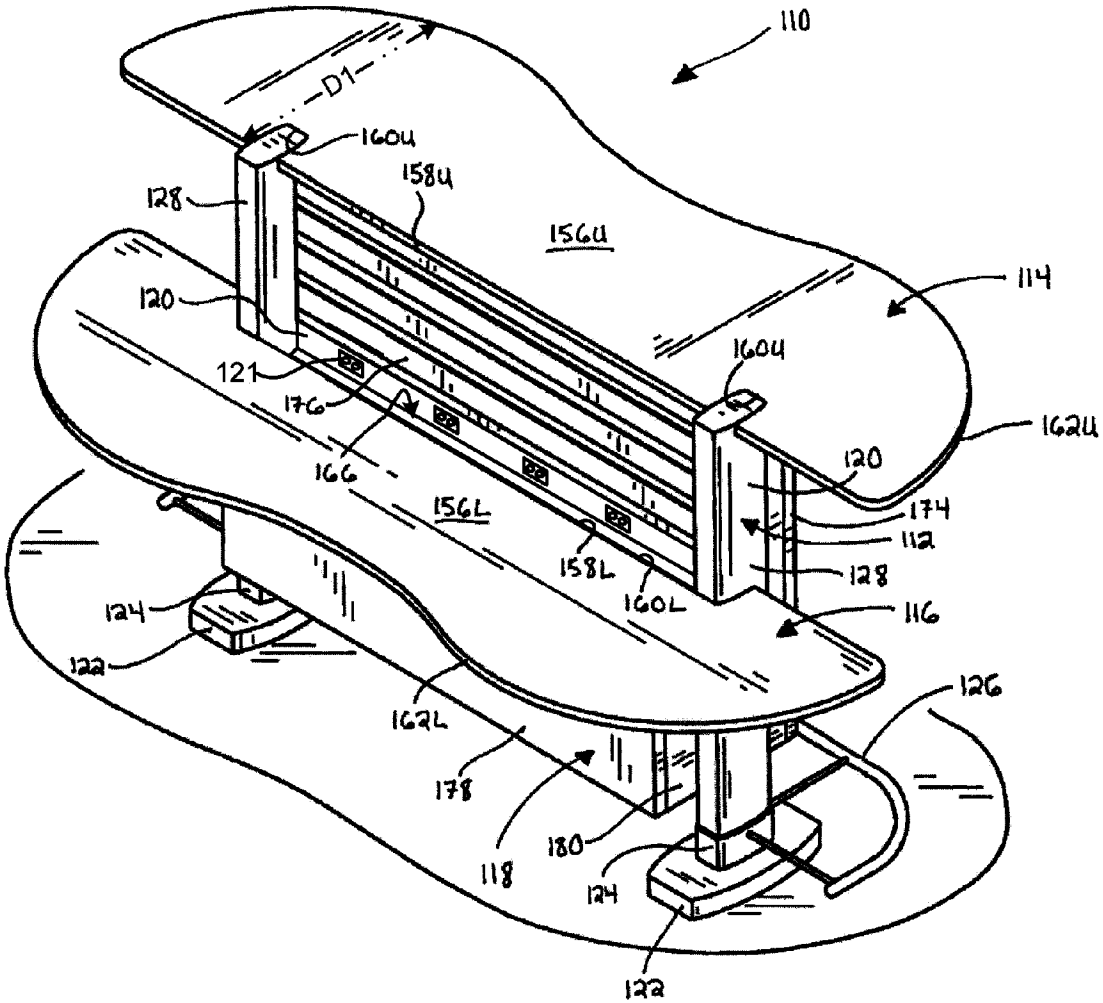
FIG. 1 is a perspective view of an exemplary dual-height workstation configuration consistent with at least some aspects of the present invention.

Referring now to the drawings wherein like reference numerals correspond to similar elements throughout the several views, the present invention will be described in the context of an exemplary workstation 110 including a support structure/member 112 that supports a first or upper work surface forming member or upper member 114, a second or lower work surface forming member or lower member 116, and a workstation housing 118. Referring specifically to FIGS. 1 through 4, support structure 112 generally comprises two leg members or legs 128, two bases 122 and a footrest assembly 126. Each base 122 is a flat rigid plate like member that engages a support surface or floor on which the workstation 110 is positioned. Although not illustrated, each base or foot member 122 may be bolted or otherwise attached to the supporting floor structure so that leg members 128 secured thereto are supported to extended upright there from.

Figure 4:
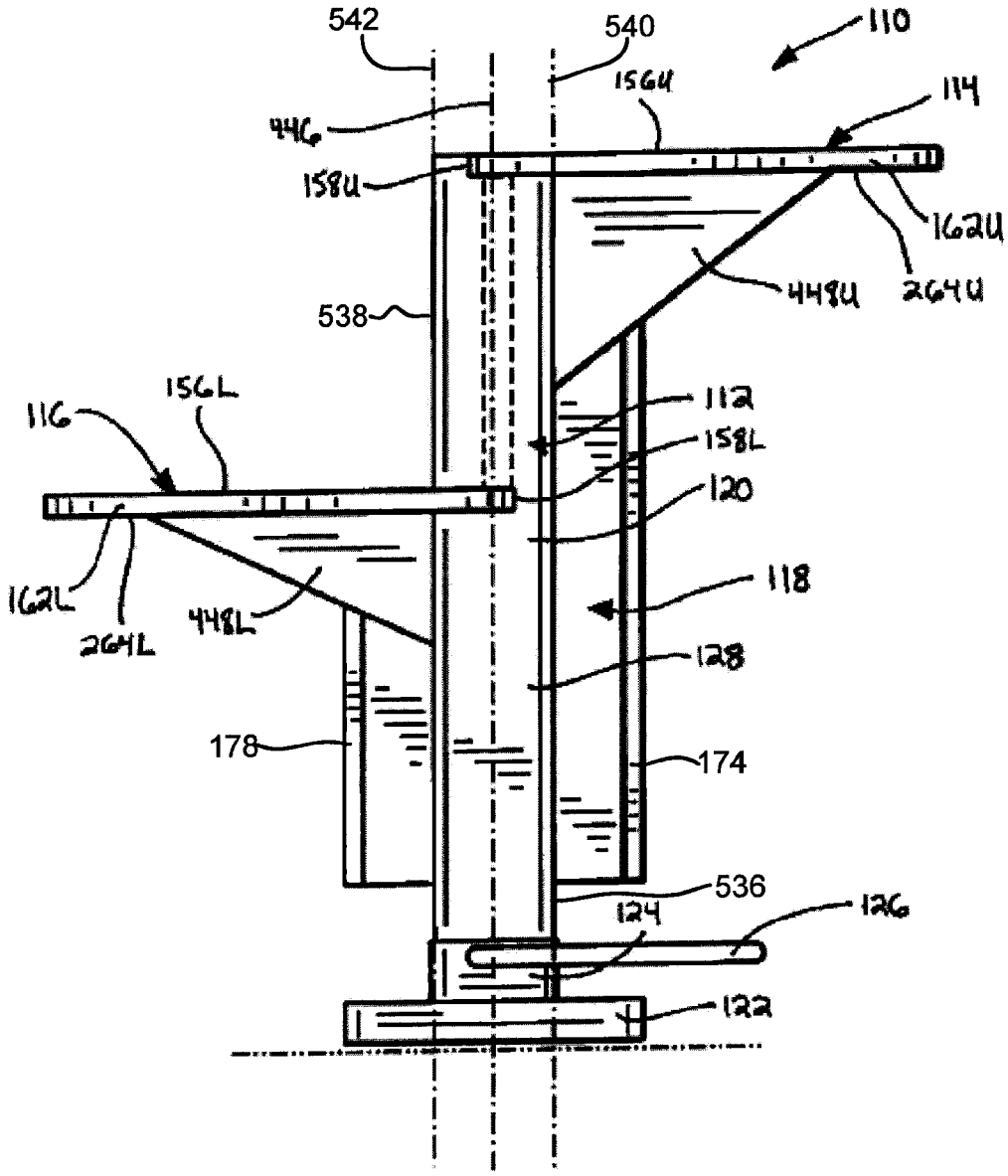
FIG. 4 is a side plan view of the configuration shown in FIG. 1.
Figure 5:
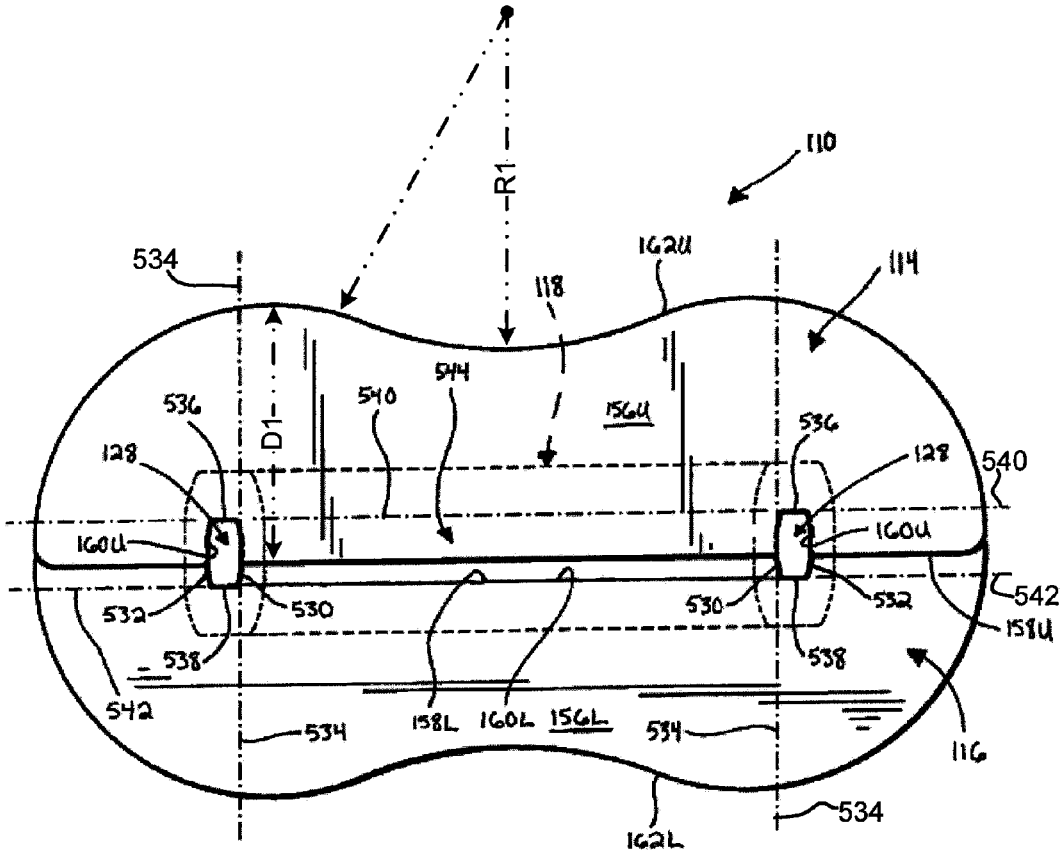
FIG. 5 is a top plan view of the configuration shown in FIG. 1.

Referring now to FIGS. 1 through 5 and specifically to FIG. 5, the vertically extending spaced-apart legs 128 have generally rectangular cross sectional shapes with slightly arcuate inner surfaces 530 and outer surfaces 532. Each leg 128 is secured (e.g., welded, bolted to, etc.) to a separate one of the base members 122 to extend vertically upward therefrom upon installation for use. The inner surfaces 530 of legs 128 each defines a leg plane 534 between which housing 118 is completely disposed. The legs 128 also include front surfaces 536 and back surfaces 538 that connect the inner and outer surfaces 530 and 532. The front surfaces 536 face a first or front direction and define a front surface plane 540. Similarly, the back surfaces 538 face a second or back direction and define a back surface plane 542. The front surface plane 540 and the back surface plane 542 define a support structure volume 544 there between, which is described in further detail below. As shown in FIG. 4, the legs 128 also define a vertical arrangement plane 446 that bisects each of the legs 128. The vertical arrangement plane 446 is also described in further detail below. The legs 128 have a vertical length dimension such that top ends of the legs 128 are at a height corresponding to a work surface height that is comfortable for a standing work surface user. To this end, the legs 128 have a length dimension H1 which result in the top ends thereof being at a height of between thirty eight and forty-five inches where dimension H1 is typically around forty-two inches. In other embodiments height H1 may be selected to be generally a bar height suitable for use by a person sitting on a stool.

Referring to FIGS. 1 and 4, support brackets 124 are mounted to legs 128 just above bases 122 and support footrail 126 at between eight and twelve inches high where rail 126 extends in the front or first direction from legs 128. Individuals may rest their feet on footrail 126 while standing to the first side of station 110 while using upper work surface 114.

Referring again to FIGS. 1 through 5, the first work surface forming member 114 is a thin (e.g., ½ to 1½ inch thick), rigid and flat member that includes parallel top and bottom surfaces 156U and 264U, respectively, and front and rear edges, 162U and 158U, respectively. Rear edge 158U is generally a straight edge and forms first and second notches 160U sized to snuggly receive portions of leg members 128 adjacent front surfaces 536. Each notch 160U has a depth dimension such that between one-half and approximately two-thirds of each leg 128 adjacent front surface 536 is receivable within the notch 160U. Front edge 162U (see FIG. 5) curves from one end of rear edge 158U to the other and the curve forms half a figure eight shape with convex edge portions near the curve ends and a concave edge portion between the two convex edge portions.

The convex portions of member 114 are dimensioned so that each portion is suitable as a workstation and, to that end, will often have a depth dimension D1 (see FIGS. 1 and 5) that is between twenty and twenty-four inches and, is typically around twenty-two inches. Dimension D1 should be selected so that member 114 can support input devices such as a keyboard and a mouse as well as paper charts, materials, etc., to the side thereof and so that a flat panel display can be placed at a comfortable distance from a keyboard user and still reside generally above the surface formed by member 114 or at a location proximate the rear edge 158U thereof. The radius of curvature R1 (see FIG. 5) of the concave portion of the curved front edge should be selected so as to accommodate a person standing thereat. For instance, in at least some embodiments the radius of curvature R1 should be approximately thirty to thirty-five inches.

In at least some embodiments notches 160U may a (?) slightly larger than the portions of legs 128 received therein so that a gap (see 1210 in FIG. 12) is formed between the edge that forms the notch and the facing surface of the received leg 128. The gap 1210 may be used to pass cables from a monitor, keyboard or other cabled devices that reside on or above member 114 to a space therebelow.

Referring again to FIGS. 1 through 5, second work surface forming member 116 is constructed in a similar fashion to member 114. To this end, member 116 is a thin, rigid and flat member including parallel top and bottom surfaces 156L and 264L, respectively and has front and rear edges 162L and 158L, respectively. Front edge 162L has a curved shape similar to the curved shape 162U of top member 114. Rear edges 158L is generally a straight edge and forms a single long notch 160L that extends a distance equal to the dimension between the oppositely facing outer surfaces 532 of legs 128 so that portions of both legs 128 proximate rear surfaces 538 can be simultaneously received in the notch 160L. Notch 160L has a depth dimension such that between one-half and approximately two-thirds of each leg 128 adjacent rear surface 538 is receivable within the notch 160L.

Referring to FIG. 4, upper and lower gussets or brackets 448U and 448L are provided for each leg 128 (i.e., there are a pair of brackets associated with each leg, one pair shown in FIG. 4). Each gusset has a similar construction and each operates in a similar fashion and therefore only gusset 448U shown in FIG. 4 is described here in detail. Gusset 448U is a generally flat and rigid triangular member that forms a right angle. Although not shown, the two edges of gusset 448U adjacent the right angle may include flanges perpendicular to the main portion of the gusset for mounting purposes. As shown, gussets 448U are securely attached to legs 128 near top ends thereof to extend to the front or first side generally above foot rest 126. Gusset 448U may be secured to leg 128 via bolts, screws, welding, or any other known mechanical or other structure or method. Lower gussets 448L are securely attached to rear surfaces 538 of legs 128 approximately midway along the lengths thereof to support member 116 at a typical work surface height (e.g., between twenty-seven and thirty-two and typically at approximately thirty inches) for a seated surface user.

Referring again to FIGS. 1 through 5, to install upper work surface forming member 114, rear edge 158U is positioned adjacent front surfaces 536 of leg 128 with notches 160U aligned with legs 128 and with bottom surface 264U resting on top edges of gussets 448U. Member 114 is slid back toward legs 128 until portions of legs 128 are received to a desired degree within notches 160U and then screws or other fasteners are used to secure member 114 to the top edges of gussets 448U. Once installed, top surface 156U of member 114, in at least some embodiments, is flush with the top ends of legs 128 (see FIGS. 1 and 4).

To install lower work surface forming member 116, rear edge 158L is positioned adjacent rear leg surfaces 538 with notch 160L aligned with legs 128 and with bottom surface 264U resting on top edges of gussets 448L. Member 116 is slid toward legs 128 until the legs are received within notch 160L to a desired extent. Next, member 116 is secured to gussets 448L. When installed, the convex portions of members 114 and 116 are generally aligned as illustrated best in FIG. 5.

Figure 6:
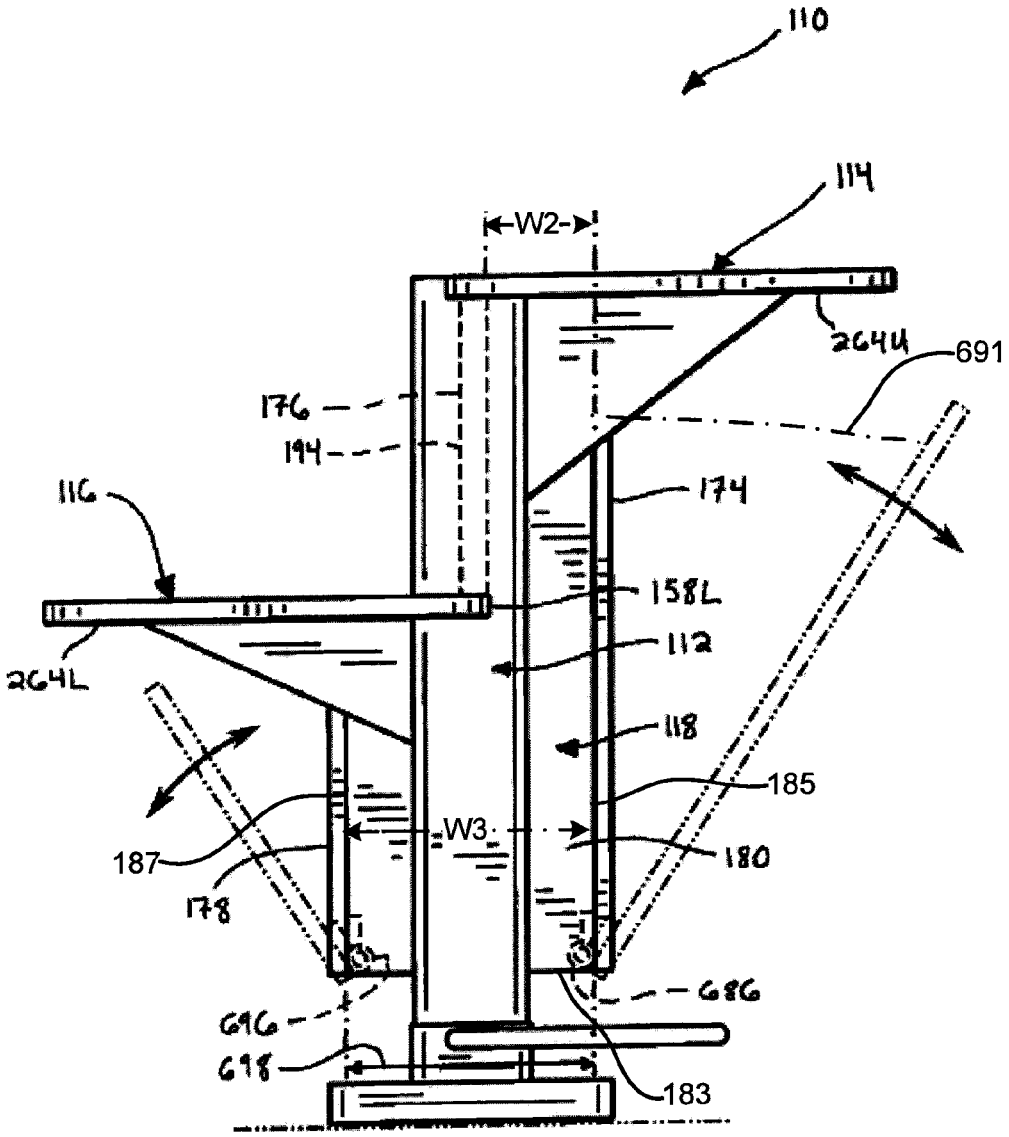
FIG. 6 is similar to FIG. 4, albeit illustrating the workstation configuration including front and rear covers shown in phantom in open positions.
Figure 7:
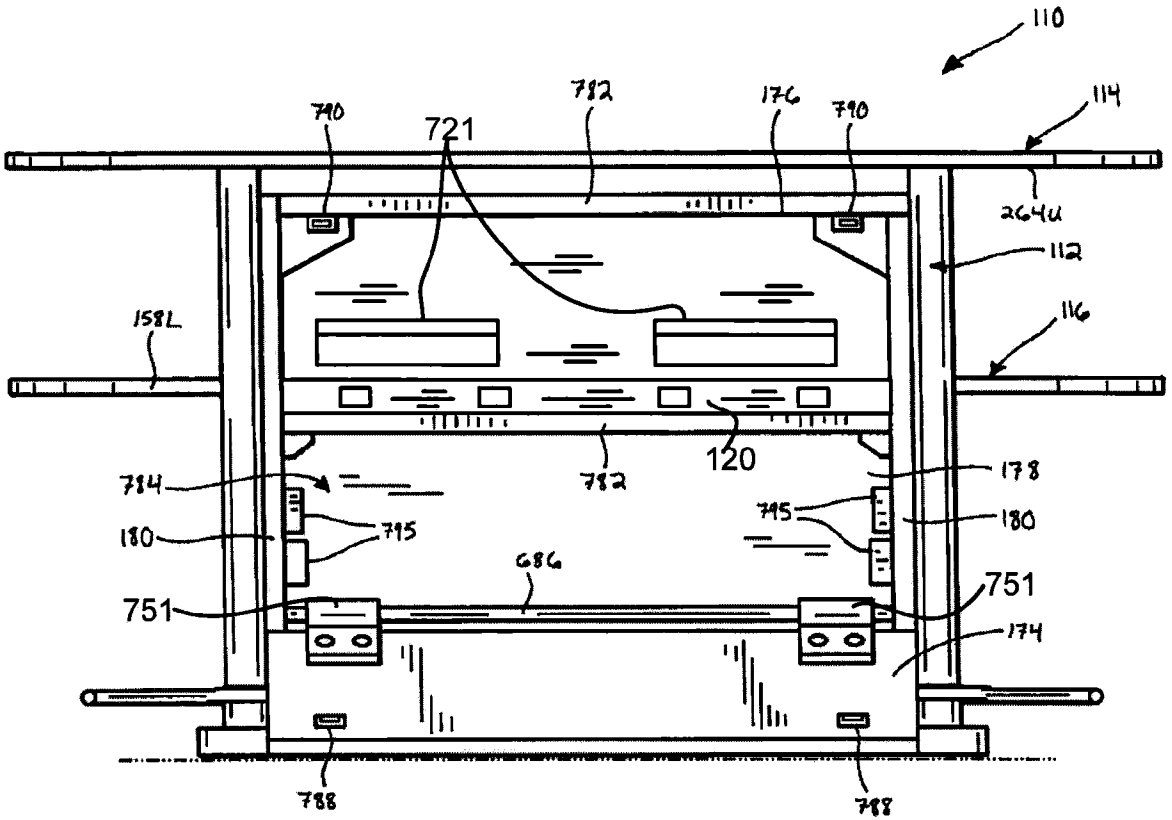
FIG. 7 is similar to FIG. 3, albeit where a front cover is shown in an open position.

Referring now to FIGS. 1, 6 and 7, housing 118 includes a front cover 174, an upper back cover 176, a lower back cover 178, and first and second side walls collectively identified by numeral 180. Front cover 174 is a rigid, flat rectilinear member having internal and external surfaces. Cover 174 has a width dimension (see FIG. 3) that is substantially identical to the distance between the facing surfaces 530 of legs 128 and has a height dimension that is less than the height of the leg members 128 so that when cover 174 is installed below upper member 114 to extend down therefrom (see FIGS. 3 and 4), a bottom edge thereof resides above and spaced from foot rest 126.

Lower back cover 178 is a rigid, flat rectilinear member having internal and external surfaces and has a width dimension similar to the width dimension of front cover 174 and a height dimension approximately half the height dimension of front cover 174 so that when installed below lower member 116 to extend down therefrom, a bottom edge thereof is at essentially the same height as the bottom edge of front cover 174.

Upper back cover 176 is a rigid, substantially flat rectilinear member having internal and external surfaces. In at least some embodiments the external surface of upper back cover 176 forms slats or grooves for receiving mechanical fasteners for fastening accessories such as light support arms, flat panel monitor arms, pencil holders, shelf members, etc. An exemplary slat forming cover structure in common use today is generally referred to as slat wall. Cover 176 has a width dimension equal to the distance between the facing surfaces of legs 128 and a height dimension that is, in at least some embodiments, less than the vertical distance between the bottom surface 264U of upper member 114 and the top surface 156L of lower member 116, so that when cover 176 is installed and extends down from the bottom surface of member 114 as illustrated, a bottom edge thereof stops short of the vertical height of the top surface 156L of member 166 (see FIGS. 1 and 2).

Figure 2:
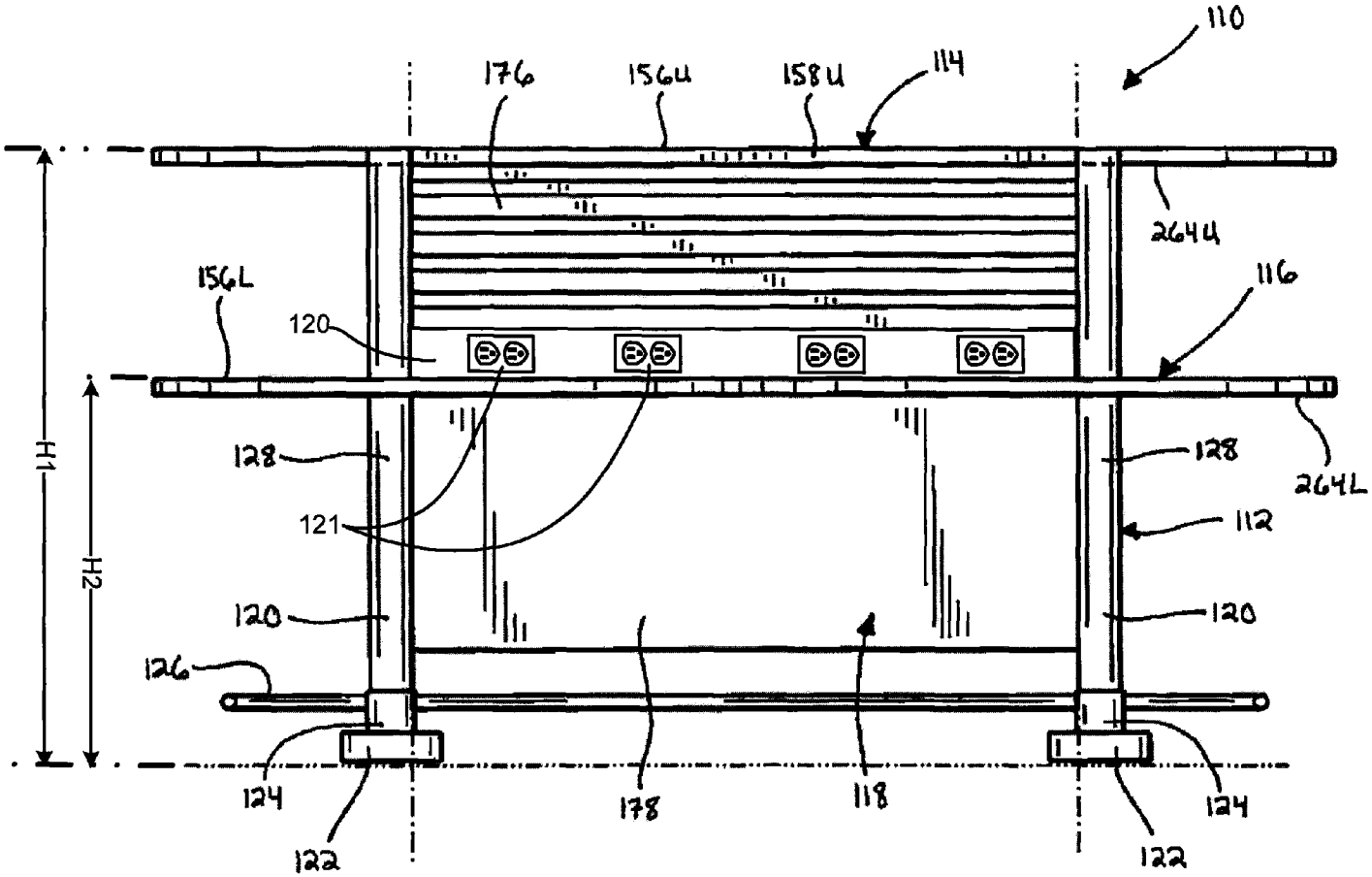
FIG. 2 is a rear plan view of the configuration shown in FIG. 1.
Figure 3:
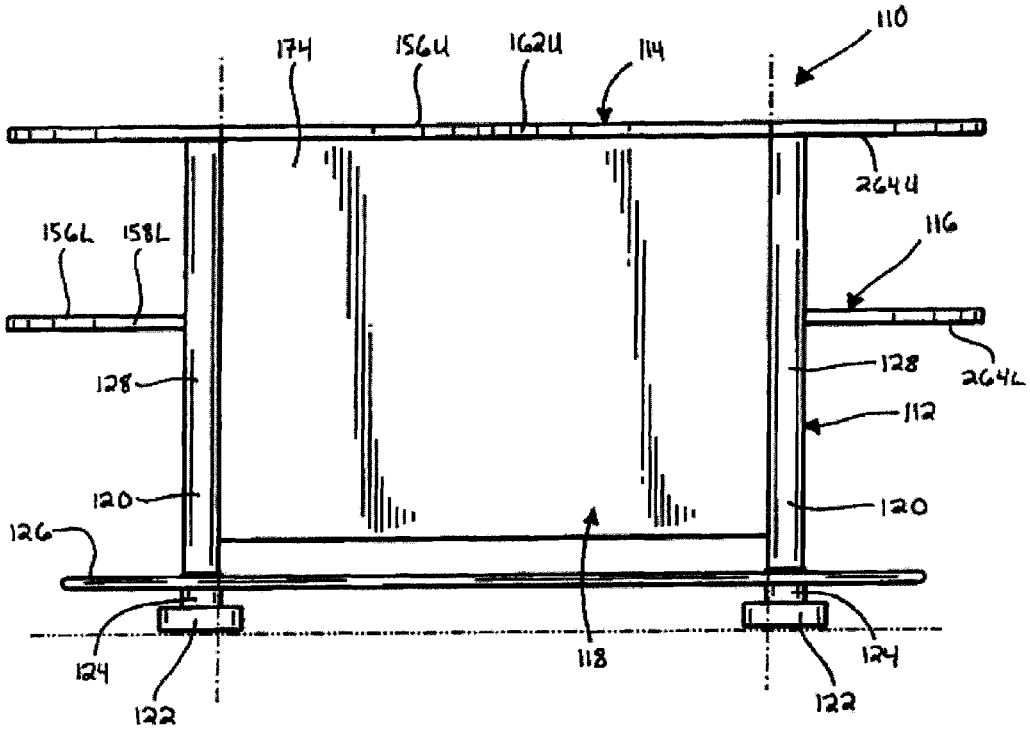
FIG. 3 is a front plan view of the configuration shown in FIG. 1.

Referring still to FIGS. 1 and 2, a rigid and elongated wire management tray member 120 is provided in at least some embodiments. As the label implies, tray member 120 is provided to support power and/or data receptacles and also to control and restrict power and data cables. To this end, referring also to FIG. 8, tray member 120 is formed of bent sheet metal and includes two elongated plate like members 123 and 125 as well as first and second end tabs 127 and 129. Each of members 123 and 125 is a rigid flat and elongated rectangular member and members 123 and 125 are connected along one long edge. Member 123 forms four receptacle receiving openings 131 that are generally equispaced along the length of member 123. Tabs 127 and 129 extend from end edges of member 123 in a direction opposite the direction in which member 125 extends. Midway along the long edge of member 125 opposite the edge to which member 123 is attached, member 125 forms a notch 133 for retaining/restricting cables that pass into the trough formed by tray member 120. Mounting holes 135 are provided in tabs 127 and 129 for mounting tray member 120 between legs 128. Member 120 has a length dimension substantially equal to the width dimension of upper back cover 176.

Figure 9:
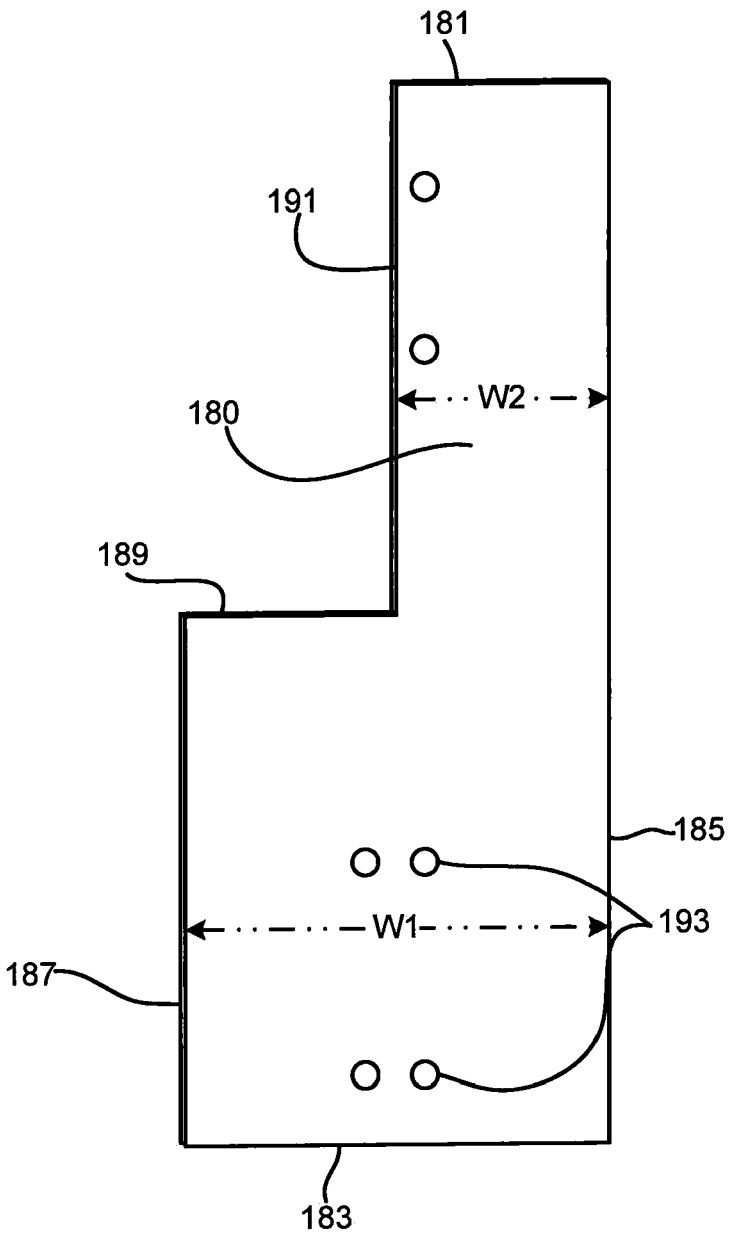
FIG. 9 is a perspective view of a side wall member that forms a portion of the configuration shown in FIG. 1.

Referring to FIGS. 1, 2 and 9, each side wall 180 is a rigid flat wall member that has internal and external surfaces, top and bottom parallel edges 181 and 183, respectively, first and second parallel lateral edges 185 and 187, respectively, an intermediate horizontal edge 189 and an intermediate vertical edge 191. The dimension between top and bottom edges 181 and 183 is the same as the height dimension of front cover 174. A width dimension W1 between lateral edges 185 and 187 defines the width of the space formed by housing 118. In the illustrated embodiment with width of wall 180 is selected so that there will be a substantial overhang of each work surface forming member 114 and 116 after station 110 is assembled. For instance, the width of wall 180 may be approximately two-thirds of a depth dimension associated with each member 114 and 116 where the depth dimension D (see FIG. 1) is the largest dimension between the front and rear edges of one of the members 114 and 116. In this case, because only about one-half of wall 180 is located under each member 114 and 116 after installation, approximately two-thirds of each work surface forming member 114 and 116 will overhang and extend part the housing 118 therebelow.

Intermediate horizontal edge 189 and vertical edge 191 are parallel to the top edge 181 and lateral edge 187, respectively, and clip off approximately one-quarter of the area defined by bottom edge 183 and lateral edge 185. In the illustrated embodiment, a second width dimension W2 between lateral edge 185 and intermediate edge 191 is approximately one-half dimension W1. A height dimension between bottom edge 183 and intermediate edge 189 is substantially equal to the height dimension of bottom rear cover 178. Each side wall 180 forms mounting holes collectively labeled 193 in FIG. 9.

Referring now to FIGS. 1 and 2, to install the upper back cover 176 and tray member 120, cover 176 is positioned between leg members 128 so that the slat wall surface thereof generally faces in the direction of lower work surface forming member 116 and so that the slat wall surface is recessed back from the rear surfaces 538 (see also FIG. 5) of legs 128 with a top edge of cover 176 abutting the underside of upper work surface forming member 114. Bolts or other mechanical fasteners are used to secure cover 176 in place.

Next, tray member 120 is positioned adjacent the lower edge of cover 176 with member 123 parallel to and generally coplanar with the front slat wall surface of cover 176 and with member 125 extending generally in the direction of surface forming member 116. Here, the dimensions of cover 176 and member 123 of tray member 120 should be such that upon installation, member 125 is in a vertical plane which is below (e.g., one to two inches) the top surface of member 116 (see FIG. 1) so that tray member 120 forms a sunken tray channel generally at 166. In this case, excess lengths of power/data cables can be stored in the tray channel to minimize clutter on the top surface of member 116. Power and data receptacles 137 can be mounted in openings 131 in any manner known in the art.

To install side walls 180, each wall is positioned adjacent an interior surface 530 of a separate one of legs 128 with the top edge 181 and intermediate edge 189 abutting the bottom surface 264U and 264L of work surface forming members 114 and 116, respectively. Screws or other mechanical fasteners are used to secure side walls 180 to legs 128 in the positions illustrated in FIG. 4.

Figure 10:
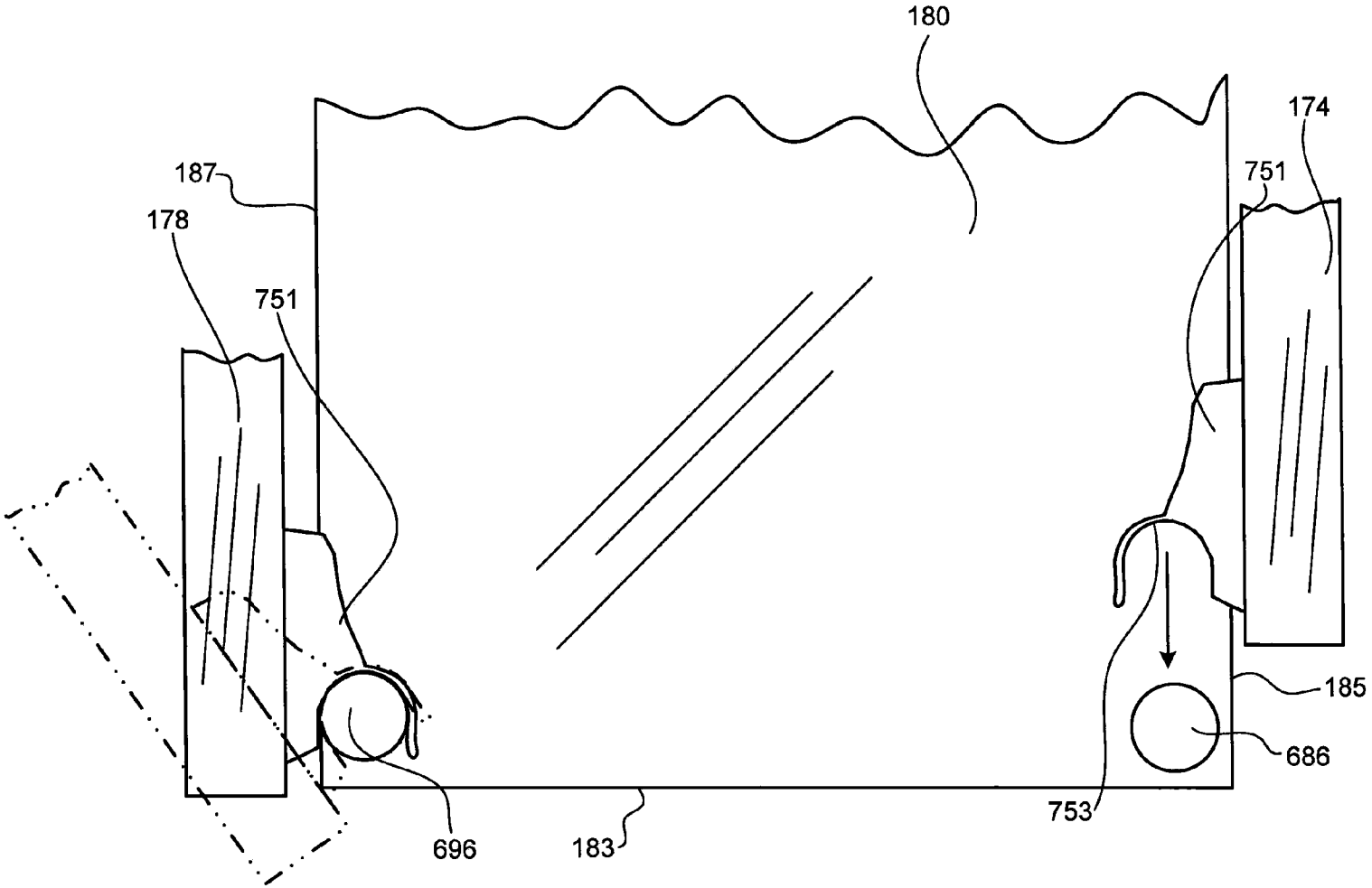
FIG. 10 is a schematic view illustrating cover and hinge brackets that form part of the station shown in FIG. 1.

Referring now to FIGS. 6, 7 and 10, two cover mounting bars 686 and 696 are shown mounted between side walls 180. As illustrated, bar 686 is securely attached to the internal surface of each side wall 180 proximate the lower corner formed by bottom edge 183 and the long lateral edge 185. Bar 686 is horizontally oriented and can be attached to walls 180 in any manner (e.g., brackets, etc., not shown). Bar 696 is securely attached to the internal surface of each side wall 180 proximate the lower corner formed by bottom edge 183 and the short lateral edge 187 and is horizontally oriented.

Referring still to FIG. 7 and also to FIG. 10, front cover 174 has two hinge brackets 751 mounted to an internal surface near the bottom edge which cooperate with bar 686 to form a hinge. To this end, each bracket 751 forms a C-shaped downwardly facing channel 753 that receives bar 686 so that the brackets 751 and cover 174 can rotate or pivot about a central axis formed by bar 686. Thus, after installation, cover 174 can be moved between a closed position shown in FIG. 6 and an open position shown in FIG. 6 (see phantom) and another open position shown in FIG. 7. Because each bracket 751 is open downward, cover 174 can be easily removed from bar 686 by simply lifting upward so that brackets 751 disengage bar 686. Once completely removed from the bar 686, the cover 174 can be placed aside to allow a station user unfettered access to the components within the housing cavity for installation, maintenance and repair purposes.

To maintain cover 174 in the closed and generally vertical position as in FIG. 6, a closure maintaining subassembly may be provided. In FIG. 7, exemplary closure maintaining subassemblies include magnetic latching mechanisms 788/790. Each latching mechanism includes a magnet 790 mounted to a side wall 180 and a metal plate 788 mounted to the internal surface of cover 174 where the plate and magnet are positioned such that when cover 174 is swung into the closed position, the plate 788 is adjacent the associated magnet 790 and magnetically latches thereto. The closing magnetic force can be overcome by simply pulling on the lateral edge(s) of cover 174 thereby opening the cover to access the space formed by housing 118. Other mechanical latching mechanisms are contemplated wherein one part on cover 174 mates with another part mounted to side walls 180 or other housing structure when cover 174 is in the closed position. Although not shown, a locking mechanism may be provided in some applications to maintain cover 174 in the closed position unless affirmatively unlocked. Here, suitable mechanical locking mechanisms are well known in the art.

As seen in FIGS. 6 and 10, in the illustrated embodiment, rear cover 178 is mounted to bar 696 in a fashion similar to that described above with respect to cover 174. In at least some embodiments one of the covers 174 or 178 may be mounted to be removed or opened while the other cover is mounted in a more permanent fashion. Referring to FIG. 4, in at least some embodiments covers 174 and 178 are substantially equidistant from plane 540 when closed.

As seen in FIG. 6, an upper cavity width W2 is less than a lower housing cavity width W3. This configuration affords sufficient leg room for a nurse using the seated height work surface 116 while affording a relatively deep work surface 116 dimension. Here, a user's feet can be accommodated under the housing 118 if additional footroom is needed and the width W3 of housing 118 ensures that the user's feet remain hidden from view on the opposite side of station 110.

Referring again to FIG. 7, in at least some embodiments, additional power/data receptacles may be mounted inside housing cavity 784. In addition, other shelf or bracket structures 721 may be mounted in cavity 784 for supporting computers, networking equipment, etc.

Referring again to FIG. 6, it is contemplated that in some embodiments a flexible tether cord 691 (shown in phantom) or the like may be provided to prevent cover 174 (or cover 178) from inadvertently crashing into a floor structure which could damage the covers or other items in the vicinity of station 110. In this regard, cord 691 could be secured at opposite ends to the interior surface of cover 174 and to some structure (e.g., an internal surface of one of the side walls 180) inside the housing cavity 784. When associated cover 174 is in the closed position, cord 691 would simply fold into cavity 784 and when cover 174 is rotated to the open position, cord 691 would become taut and maintain cover 174 in an angled orientation.

Figure 11:
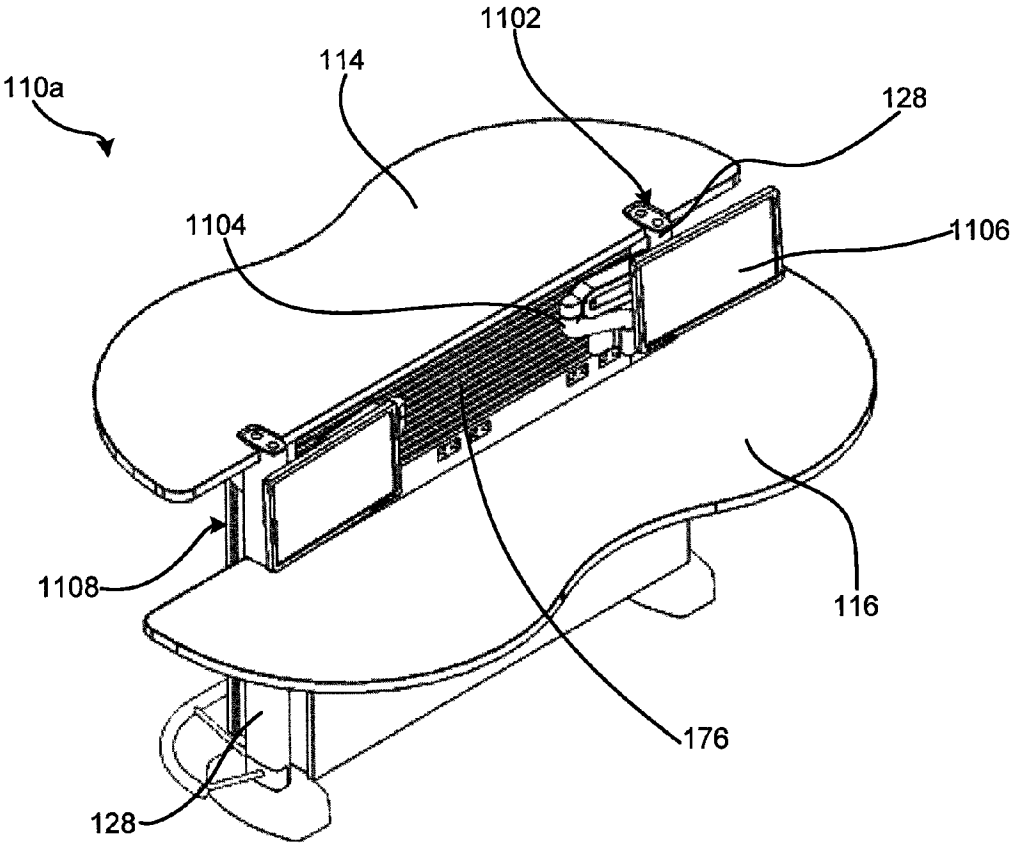
FIG. 11 is a perspective view of a configuration similar to the configuration shown in FIG. 1, albeit where two flat panel display arm assemblies are attached to an upper rear cover of the configuration.

Workstation 110 may be modified from the above description without departing from the scope of the invention. For example, in some embodiments, referring to FIG. 11, a station 110*a* may include flat panel monitor assemblies 1102 and 1108 mounted to the slat wall front surface of top rear cover 176. Each of assemblies 1102 and 1008 is similarly constructed and therefore, in the interest of simplifying this explanation, only assembly 1102 is described in any detail. Assembly 1102 includes a monitor support arm assembly 1104 and a flat panel display screen 1106. Arm 1102 may take any of several different forms known in the art. One particularly useful arm structure is described in U.S. patent application Ser. No. 11/445,804 which is titled "Support Arm Assembly" and which was filed on Jun. 2, 2006 and which is incorporated herein by reference. In particular, FIG. 27 of the above referenced patent application teaches a system for mounting an articulating monitor arm to a slat wall surface. FIG. 1 of the above referenced application teaches an arm assembly that supports a display for movement up, down, forward and backward, left and right and for forward and rearward tilting. In some cases the arm of FIG. 1 may be combined with the mounting structure of FIG. 27 to provide a display 1106 mounted to the slat wall surface of cover 176 for use by a nurse adjacent lower member 116.

Figure 12:
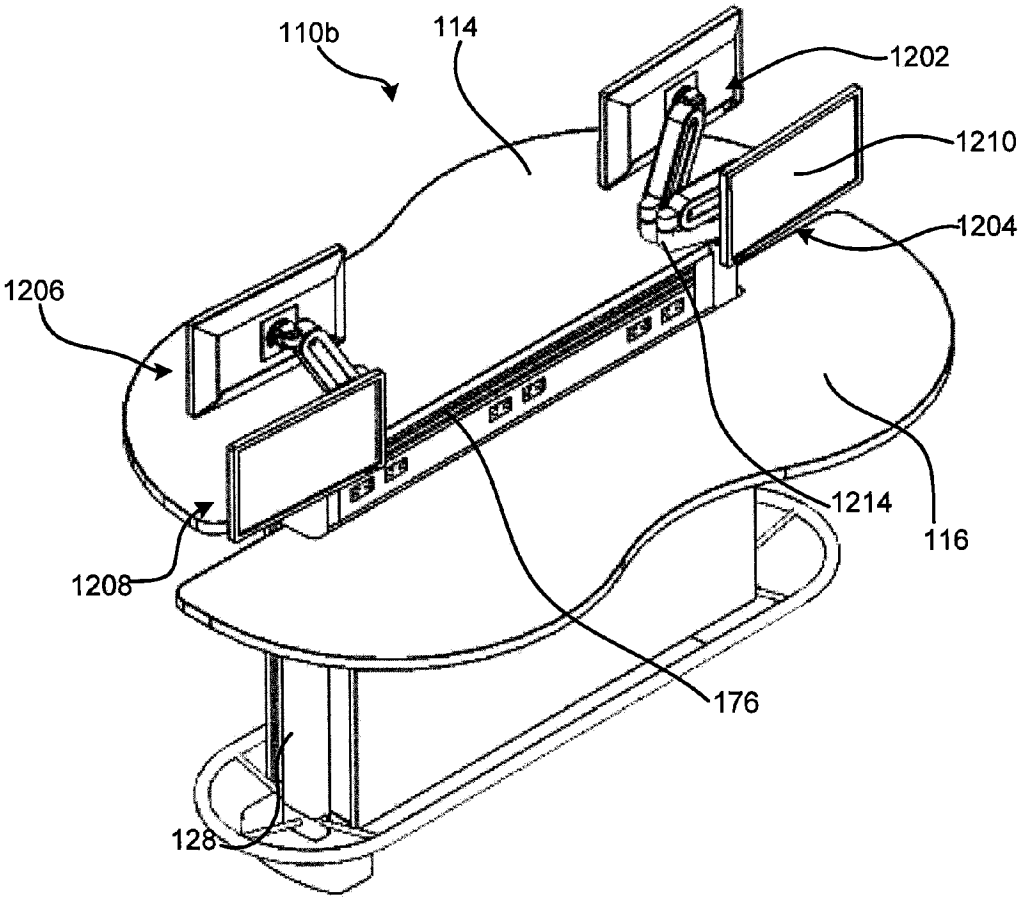
FIG. 12 is similar to FIG. 11, albeit where the relative heights of the top members are different and where four monitor arm subassemblies are mounted to the top ends of support legs, two arm assemblies per each support leg.
Figure 13:
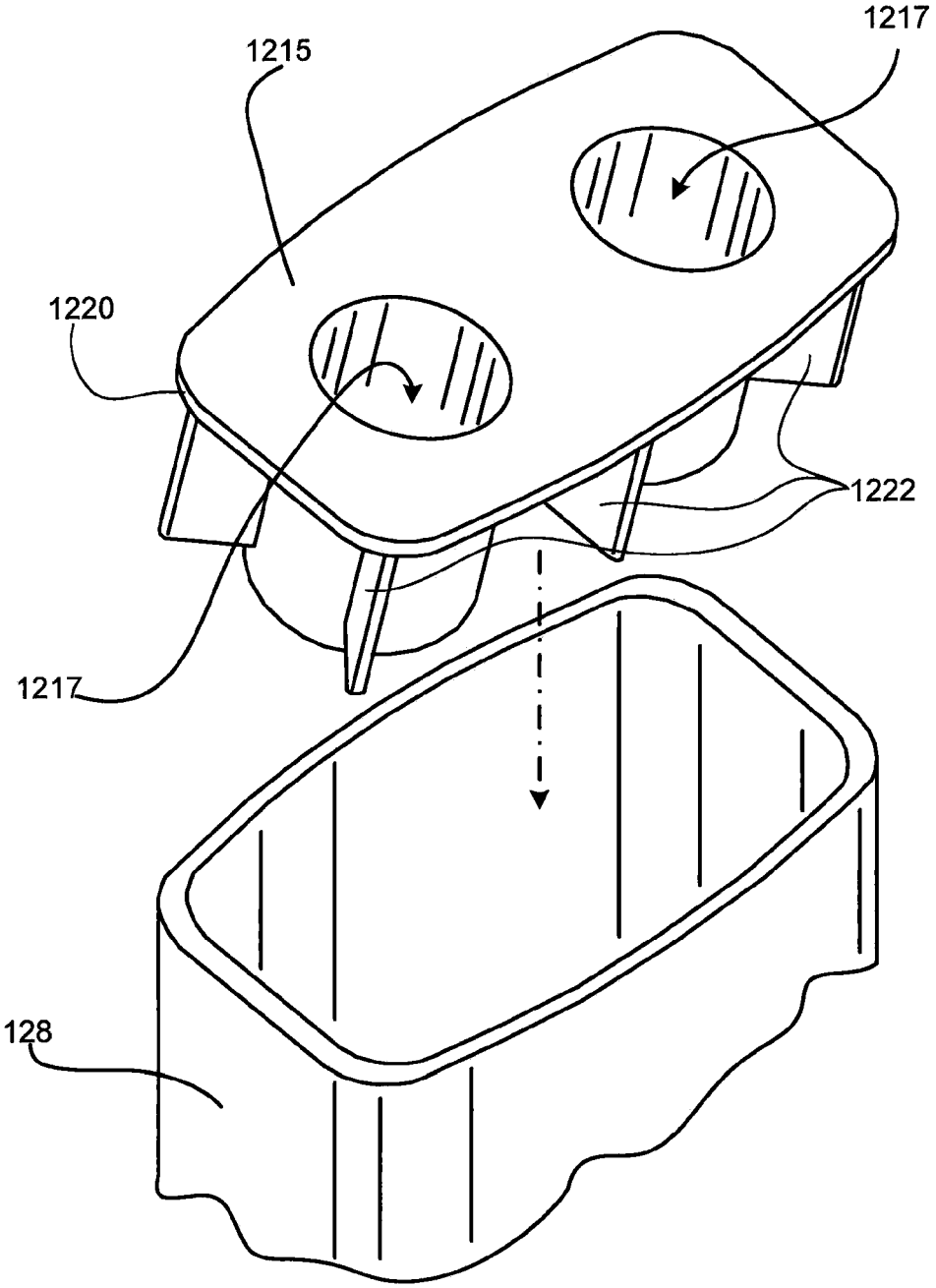
FIG. 13 is a perspective view of a support arm insert spaced from the receiving top end of one of the leg members shown in FIG. 1.
Figure 14:
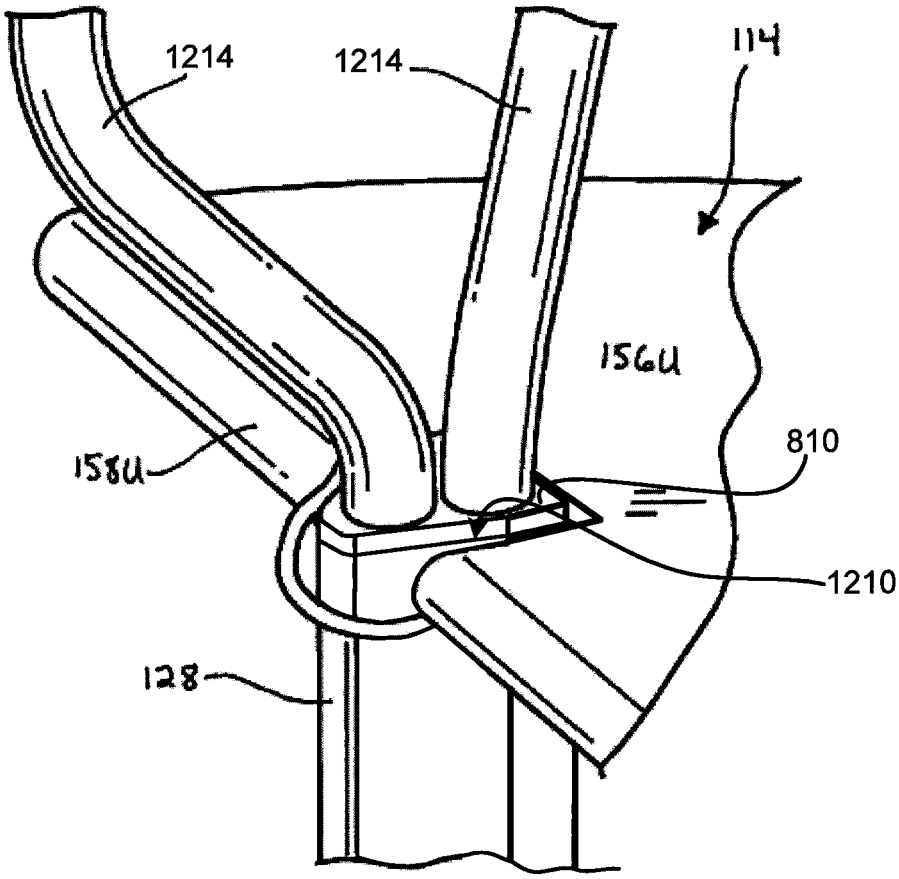
FIG. 14 is an enlarged view showing two arm assemblies mounted at the top end of a support leg.

As another example, referring to FIGS. 12 and 14, a station 110*b* may include display assemblies 1202, 1204, 1206 and 1208 mounted at the top ends of legs 128. In this case, referring also to FIG. 13, a fitting 1215 is provided that can be inserted into a top end of leg 128 where the fitting 1215 forms two sockets collectively labeled 1217 (see also FIG. 13). Each socket is dimensioned to receive a mounting post end (see 116 in FIG. 4 of the referenced application) of one of the arm assemblies. In the illustrated embodiment fitting 1215 includes an upper lip 1220 and several ribs 1222 that extend downward there from where the lip limits the extent to which the fitting will move into the open end of a leg and the ribs 1222 are designed to deform somewhat when the fitting 1215 is press fit into the open top end of a leg 128. Thus, the fitting 1215 jams into the opening so that no special tools are required to install the fitting 1215. Once installed, the arm assemblies 1214 extend upward from fitting 1215 and each supports a separate flat panel display for articulated motion above the top surfaces of members 114 and 116. As shown in FIG. 12, a first display attached to each post is mounted to be viewable by a nurse proximate member 114 and a second display attached to each post is mounted to be viewable by a nurse or the like proximate member 116.

Figure 8:
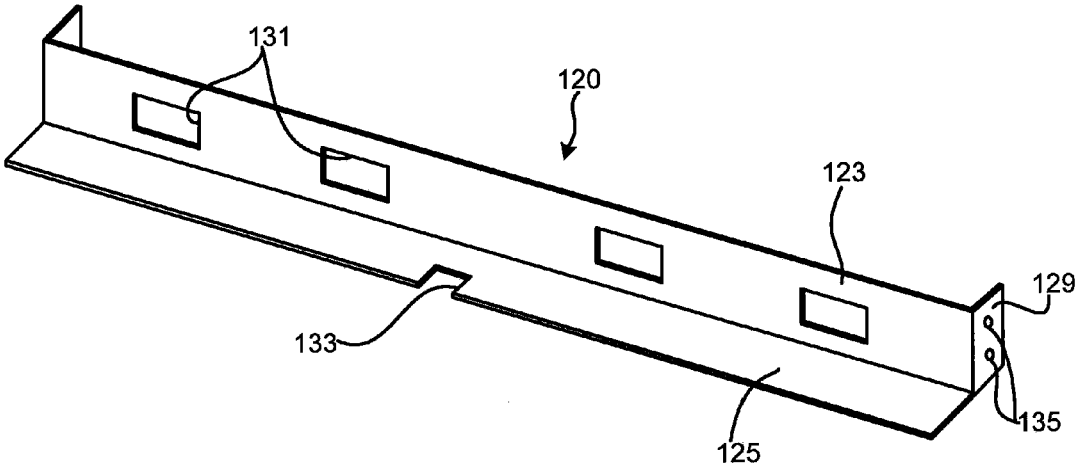
FIG. 8 is a perspective view of a wire management subassembly that forms part of the configuration shown in FIG. 1.
Figure 15:
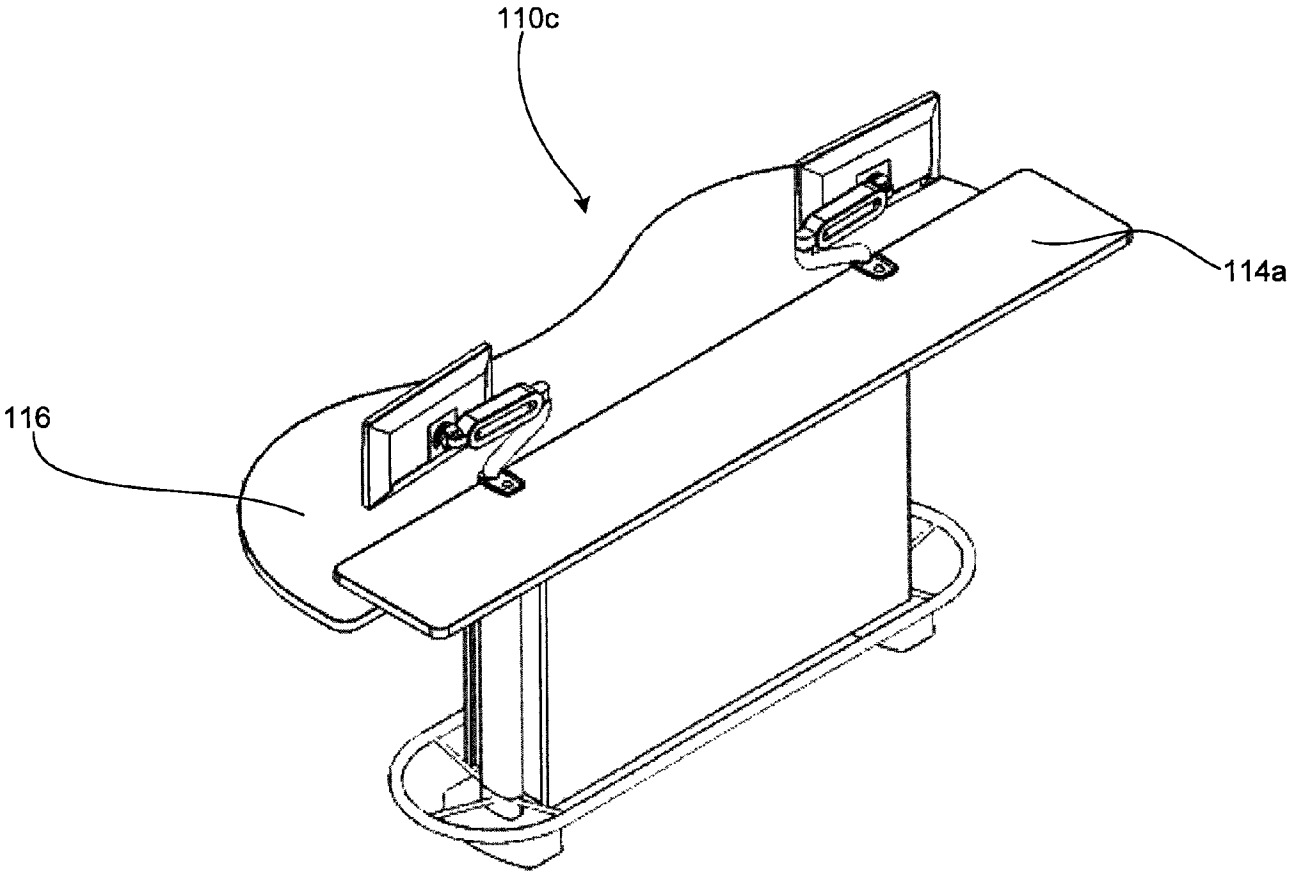
FIG. 15 is a perspective view similar to the view of FIG. 11, albeit where a top work surface forming member has a rectilinear shape and only a single monitor support subassembly is mounted to the top of each of the legs.

As still one other example, FIG. 15 illustrates another station 10*c* that includes a rectilinear upper work surface forming member 114*a* instead of the half figure-8 design shown in the previous embodiments. In addition, station 110*c* includes only one monitor support subassembly mounted to each of the legs 128. In this case each monitor may be used on either side of the station.

From the above disclosure it should be appreciated that workstation 110 is appropriate for simultaneous use by multiple individuals. For example, two individuals may use the upper work surface 114 and two individuals may use the lower work surface 116 simultaneously. As another example, two individuals may use the lower work surface 116 simultaneously while interacting with patients/visitors that approach the upper work surface 114. Here, to reduce the distance between a nurse and a visitor at station 110, both the nurse and visitor may move into the concave portions of the members 114 and 116. As yet another example, two individuals may use the upper work surface 114 for some tasks (e.g., performing a quick fact check related to a patient to be visited) and the lower work surface 116 for other tasks (e.g., transferring data form a palm type device to a network and reviewing/altering the information prior to persistent storage).

It should also be appreciated that the above described embodiment provides a station configuration where multiple height surfaces have been provided that can be used for different purposes that are encouraged by the station design. In this regard, on one hand the lower work surface forming member 116 is positioned in a semi-private space where upper cover 176 as well as the portion of top member 114 adjacent a rear edge thereof and portions of leg members 128 together form a recessed alcove. Upper back or rear cover 176 is positioned within the support structure formed by legs 128 so that a portion of the cavity/support structure volume 544 is positioned between the upper rear cover 176 and the back surface plane 540 (see FIGS. 4 and 5). The slat wall surface of upper cover 176 is recessed from the rear surface 538 of leg members 128 and the rear edge 154U of top member 114 and the surface recession enhances the feeling of privacy. On the other hand, when a station user wants to temporarily and quickly use a work surface, the user has the option to use the relatively less private surface provided by top member 114.

Moreover, it should be recognized that the configuration illustrated has a particularly aesthetically pleasing symmetrical configuration when viewed from the side (see FIG. 4) as the cavity forming housing 118 has equal depth on both sides of the legs 128 while still providing ample leg room for seated as well as standing station users below members 114 and 116.

Several specific embodiments of the present invention have been described above. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Thus, the invention is to cover all modifications, equivalents, and alternatives falling within the spirit and scope of the invention as defined by the following appended claims.

What is claimed is:

1. A furniture arrangement comprising:

a support structure extending upward from a base end;

a first work surface forming member supported by the support structure at a first vertical height;

a second work surface forming member supported by the support structure at a second vertical height and extending to a first side of the support structure where the second vertical height is lower than the first vertical height, the second work surface forming member including an undersurface;

a first cover supported by the support structure and extending downward below the first work surface forming member to a lower edge below the second vertical height;

a second cover supported by the support structure and extending downward from a height proximate the undersurface of the second work surface forming member and spaced from the first cover wherein the first and second covers bound a housing cavity having a housing cavity width; and at least one horizontal channel forming member supported by the support structure between the first and second work surface forming members and facing the first side of the support structure, the horizontal channel configured for attaching accessories to the arrangement.

2. The arrangement of claim 1 wherein the first work surface forming member extends to a second side of the support structure opposite the first side, the first work surface forming member having an undersurface and wherein the first cover extends downward from the undersurface of the first work surface forming member.

3. The arrangement of claim 2 wherein the support member includes at least first and second substantially vertical and spaced apart legs.

4. The arrangement of claim 3 wherein the first and second legs include first and second parallel surfaces that are within first and second leg planes and wherein the first cover is located at least in part outside the space between the first and second leg planes.

5. The arrangement of claim 4 wherein the second cover is located at least in part outside the space between the first and second leg planes.

6. The arrangement of claim 5 further including a third cover extending from an undersurface of the first work surface forming member downward so that an external surface thereof is located proximate, above and facing a work surface formed by the second work surface forming member.

7. The arrangement of claim 6 wherein the channel forming member is flush with the third cover.

8. The arrangement of claim 6 further including at least one power receptacle mounted to the third cover where the receptacle is substantially flush with an external surface of the third cover.

9. The arrangement of claim 7 further including at least one power receptacle located below the horizontal channel forming member.

10. The arrangement of claim 8 wherein the second work surface forming member including a central notch formed in an otherwise substantially straight rear edge, the central notch aligned with the third cover.

11. The arrangement of claim 8 wherein at least one of the first and second covers is mounted for release and movement into an open position enabling access to the housing cavity.

12. The arrangement of claim 11 wherein the at least one of the first and second covers that is mounted for movement is hingedly mounted for rotational movement between the open position and a closed position.

13. The arrangement of claim 5 further including at least a first mounting bar that extend between the first and second legs, at least one of the first and second covers mounted to the mounting bar for rotation about the mounting bar between a closed position in which the cover is substantially parallel with the other of the first and second covers and an open position in which the cover is angled with respect to the other of the first and second covers to enable access to the housing cavity.

14. The arrangement of claim 13 further including at least one monitor support arm supported by the support structure to support a flat panel monitor above a top surface of the first work surface forming member, the at least one monitor support structure supporting the monitor for rotation between positions in which the monitor faces either of the first and the second sides of the support structure.

15. The arrangement of claim 1 wherein the second work surface forming member extends to a second side of the support structure opposite the first side, the arrangement further including at least one monitor support arm supported by the support structure to support a flat panel monitor above a top surface of the first work surface forming member, the at least one monitor support structure supporting the monitor for rotation between positions in which the monitor faces either of the first and the second sides of the support structure.

16. The arrangement of claim 15 wherein cables for the monitor pass into the housing cavity between the first and second covers.

17. The arrangement of claim 16 further including at least one cable tray supported within the housing cavity.

18. The arrangement of claim 16 wherein the cable tray is mounted to an internal surface of the first cover member.

19. The arrangement of claim 18 wherein the housing cavity is substantially open downward.

20. The arrangement of claim 19 wherein at least one receptacle is supported between the first and second work surface forming members and faces the second side.

21. The arrangement of claim 1 wherein the first work surface forming member forms a rear edge and extends to a second side of the support structure opposite the first side, the second work surface forming member having a rear edge, a portion of the first work surface forming member proximate the rear edge of the first work surface forming member vertically overlapping a portion of the second work surface forming member proximate the rear edge of the second work surface forming member.

22. The arrangement of claim 21 wherein the first work surface forming member has a top surface and wherein the support structure resides completely below the top surface of the first work surface forming member.

23. A furniture arrangement comprising:

a support structure extending upward from a base end;

a first work surface forming member having a rear edge, supported by the support structure at a first vertical height and extending to at least a first side of the support structure;

a second work surface forming member having a rear edge, supported by the support structure at a second vertical height and extending to a second side of the support structure opposite the first side where the second vertical height is lower than the first vertical height, a portion of the first work surface forming member proximate the rear edge of the first work surface forming member vertically overlapping a portion of the second work surface forming member proximate the rear edge of the second work surface forming member; and at least one horizontal channel forming member supported by the support structure between the first and second work surface forming members and facing the first side of the support structure, the horizontal channel configured for attaching accessories to the arrangement.

24. The arrangement of claim 23 wherein the first work surface forming member has a top surface and wherein the support structure resides completely below the top surface of the first work surface forming member.

25. The arrangement of claim 23 wherein each of the first and second work surface forming members extends laterally to third and fourth sides of the support structure that are perpendicular to the first and second sides.

26. A furniture arrangement comprising:

a support structure extending upward from a base end;

a first work surface forming member supported by the support structure at a first vertical height and extending to at least a first side of the support structure;

a second work surface forming member supported by the support structure at a second vertical height and extending to a second side of the support structure opposite the first side where the second vertical height is lower than the first vertical height;

a first cover supported by the support structure and extending downward below the first work surface forming member to a lower edge below the second vertical height;

a second cover supported by the support structure and extending downward below the first work surface forming member to a lower edge such that the first and second covers together form a cavity that extends generally between the first and second vertical heights; and at least one monitor support arm supported by the support structure to support a flat panel monitor above a top surface of the first work surface forming member, the at least one monitor support structure supporting the monitor for rotation between positions in which the monitor faces either of the first and the second sides of the support structure.

27. The arrangement of claim 26 further including at least a second monitor support arm supported by the support structure to support a second flat panel monitor above a top surface of the first work surface forming member, the at least a second monitor support structure supporting the second flat panel monitor for rotation between positions in which the second flat panel monitor faces either of the first and the second sides of the support structure.

* * * * *